US009476393B2

(12) United States Patent
Kabasin et al.

(10) Patent No.: US 9,476,393 B2
(45) Date of Patent: Oct. 25, 2016

(54) HEATED FUEL INJECTOR

(71) Applicant: DELPHI TECHNOLOGIES, INC., Troy, MI (US)

(72) Inventors: Daniel F. Kabasin, Rochester, NY (US); Jason C. Short, Webster, NY (US); Patrick M. Griffin, Lake Orion, MI (US)

(73) Assignee: Delphi Technologies, Inc., Troy, MI (US)

( * ) Notice: Subject to any disclaimer, the term of this patent is extended or adjusted under 35 U.S.C. 154(b) by 459 days.

(21) Appl. No.: 13/846,982

(22) Filed: Mar. 19, 2013

(65) Prior Publication Data

US 2014/0284398 A1 Sep. 25, 2014

(51) Int. Cl.
*F02M 53/06* (2006.01)
*F23D 11/10* (2006.01)

(52) U.S. Cl.
CPC ..... *F02M 53/06* (2013.01); *F23D 11/10* (2013.01)

(58) Field of Classification Search
CPC ..... F24H 9/1827; F24H 9/1872; F24H 2250/04; F23D 11/10; F02M 53/06
USPC ..... 239/128, 135, 139, 130, 132, 133, 134; 219/205, 206, 504, 530, 540
See application file for complete search history.

(56) References Cited

U.S. PATENT DOCUMENTS 4,659,911 A * 4/1987 Ryder et al. ..... 219/521
4,684,786 A * 8/1987 Mann et al. ..... 392/441
4,898,142 A 2/1990 Van Wechem et al.
5,055,733 A * 10/1991 Eylman ..... H02N 2/043 310/328
5,361,990 A 11/1994 Pimentel
5,758,826 A 6/1998 Nines
6,102,303 A 8/2000 Bright et al.
6,109,247 A * 8/2000 Hunt ..... 123/549
6,109,543 A * 8/2000 Bright et al. ..... 239/135
6,561,168 B2 5/2003 Hokao et al.
6,578,775 B2 * 6/2003 Hokao ..... F02M 53/06 239/128
6,592,952 B1 * 7/2003 Ferguson ..... 428/10
6,757,315 B1 * 6/2004 Bragin et al. ..... 372/57
6,969,009 B2 * 11/2005 Bachmaier ..... F02M 51/0603 239/102.2
7,847,673 B2 12/2010 Scott
2002/0139871 A1 * 10/2002 Hokao et al. ..... 239/585.1
2008/0060621 A1 3/2008 Trapasso et al.
2009/0294552 A1 12/2009 Trapasso et al.
2010/0078507 A1 4/2010 Short
2010/0116903 A1 * 5/2010 Short ..... 239/135
2010/0206268 A1 8/2010 Schneider et al.
2010/0252653 A1 10/2010 Short et al.
2011/0276252 A1 * 11/2011 Kabasin et al. ..... 701/103

* cited by examiner

*Primary Examiner* — Arthur O Hall
*Assistant Examiner* — Christopher R Dandridge
(74) *Attorney, Agent, or Firm* — Joshua M. Haines

(57) ABSTRACT

A heated fuel injector for supplying fuel to a fuel consuming device includes a fuel inlet for receiving fuel, a fuel outlet for dispensing fuel from the fuel injector, and a fuel injector body extending along an axis and fluidly connecting the fuel inlet to the fuel outlet such that fuel flows within the injector body. A cylindrical heating element radially surrounds the fuel injector body and operates to heat fuel flowing through the fuel injector body. An annular space is defined between the heating element and the fuel injector body sufficiently large to accommodate thermally caused radial differential expansion between the fuel injector body and the heating element. A conductive material fills the annular space and has a melting point sufficiently low to be a liquid as the heating element operates to thereby substantially prevent transfer of mechanical stress to the heating element due to the radial differential expansion.

15 Claims, 3 Drawing Sheets

HEATED FUEL INJECTOR

TECHNICAL FIELD OF INVENTION

The present invention relates to fuel injectors for supplying fuel to a combustion chamber of an internal combustion engine; more particularly to such a fuel injector which is heated to elevate the temperature of the fuel; and even more particularly to such a fuel injector which uses a ceramic heating element formed as a hollow cylinder to heat the fuel injector.

BACKGROUND OF INVENTION

Fuel-injected internal combustion engines fueled by liquid fuels, such as gasoline, diesel, and by alcohols, in part or in whole, such as ethanol, methanol, and the like, are well known. Internal combustion engines typically produce power by controllably combusting a compressed fuel/air mixture in a combustion cylinder. For spark-ignited engines, both fuel and air first enter the cylinder where an ignition source, such as a spark plug, ignites the fuel/air charge, typically just before the piston in the cylinder reaches top-dead-center of its compression stroke. In a spark-ignited engine fueled by gasoline, ignition of the fuel/air charge readily occurs except at extremely low temperatures because of the relatively low flash point of gasoline. (The term "flash point" of a fuel is defined herein as the lowest temperature at which the fuel can form an ignitable mixture in air). However, in a spark-ignited engine fueled by alcohols such as ethanol, or mixtures of ethanol and gasoline having a much higher flash point, ignition of the fuel/air charge may not occur at all under cooler climate conditions. For example, ethanol has a flashpoint of about 12.8° C. Thus, starting a spark-ignited engine fueled by ethanol can be difficult or impossible under cold ambient temperature conditions experienced seasonally in many parts of the world. The problem is further exacerbated by the presence of water in such mixtures, as ethanol typically distills as a 95/5% ethanol/water azeotrope.

In order to enhance the cold starting capabilities of such spark-ignited engines fueled by ethanol or other blends of alcohol, it has been proposed to provide a fuel injector of the engine with a heating element which is used to elevate the temperature of the fuel that passes through the fuel injector in route to a combustion chamber of the engine where the fuel is ignited. One heating element arrangement that has been proposed is a thick-film heater that is applied directly to the outside surface of a fuel injector body of the fuel injector. The thick-film heater may be applied to the outside surface of the fuel injector body, for example, by applying an insulating dielectric layer to the outside surface of the fuel injector body, applying two electrically conductive terminals to the insulating dielectric layer, then applying a conductive resistance top layer over the insulating dielectric layer and the two terminals. When electrical power is applied to the two terminals, current flows through the conductive resistance top layer which heats up. The generated heat passes through the fuel injector body and heats the fuel that is located within the fuel injector body. However, the thick-film heater must be controlled in order prevent over-heating. The thick-film heater may be controlled by an engine control module or a stand-alone controller, for example, by open-loop or closed-loop methods. While this thick-film heater arrangement may be effective, the need to control the think film heater may add cost and complexity to the system.

Another heating element arrangement that has been proposed is a positive temperature coefficient (PTC) ceramic heating element that is positioned around the fuel injector body of the fuel injector. When electric power is applied to the PTC ceramic heating element it elevates in temperature and the resistance of the PTC ceramic heating element increases exponentially when its temperature exceeds a threshold temperature $T_{REF}$. This increase in resistance reduces the electric current that is allowed to pass through the PTC ceramic heating element, thereby allowing the PTC ceramic heating element to cool below $T_{REF}$ which allows the current to increase and again raise the temperature of the PTC ceramic heating element. This process repeats itself as long as the electric power is applied to the PTC ceramic heating element. In this way, the temperature of the PTC ceramic heating element is self-regulating, for example to a temperature range of about ±5° C. and the cost and complexity of controlling the temperature used in the previously described thick-film heater arrangement is avoided. The self-regulating temperature occurs at the Curie temperature of the PTC ceramic heating element. The Curie temperature of the PTC ceramic heating element is the temperature at which a phase change in the structure occurs, thereby changing from more crystalline structure to a more amorphous structure. This change in phase is responsible for the increase in electrical resistance of the PTC ceramic heating element and is characterized by significant mechanical dimension changes measured as the coefficient of thermal expansion (CTE). The CTE of the PTC ceramic heating element is typically greatest above the Curie temperature.

Japanese patent application publication number JP 2003-13822A describes a fuel injector with one arrangement for a ceramic heating element which is formed as a hollow cylinder and press fit closely over the metal fuel injector body. The close press fit of the cylindrical ceramic heating element over the fuel injector body mechanically stresses the ceramic heating element when the metal body that it surrounds expands preferentially with rising temperature, which may cause the ceramic heating element to crack. Providing a sufficiently wide annular clearance between the ceramic element and the fuel injector body that it surrounds to accommodate the differential thermal expansion severely reduces the thermal conductivity, as does any dead air space. Adding known thermally conductive materials in the annular space, such as solder or conductive adhesives, improves conductivity, but effectively reintroduces the effect of a close press-fit.

U.S. Pat. No. 6,578,775 to Hakao describes a fuel injector with another arrangement for a ceramic heating element, obviously a response to the problems outlined above. Hakao describes a pair of arc-shaped ceramic heating elements that are pressed onto the outer periphery of the fuel injector body by a resilient clip or heater holder. By, in effect, pre-breaking the cylindrical ceramic piece into a pair of arc-shaped ceramic heating elements, the risk of cracking the ceramic heating elements present in JP 2003-13822A as described earlier is mitigated. However, the effectiveness of the ceramic heater arrangement of Hakao is reduced because the entire perimeter of the fuel injector body is not heated and the complexity of the heating arrangement is increased by the additional electrical terminals that are needed in order to apply electric power to each ceramic heating element, as well as the resilient press-fit mechanism.

What is needed is a heated fuel injector which minimizes or eliminates one or more of the shortcomings as set forth above.

SUMMARY OF THE INVENTION

Briefly described, a heated fuel injector is provided for supplying fuel to a fuel consuming device. The heated fuel injector includes a fuel inlet for receiving fuel, a fuel outlet for dispensing fuel from the fuel injector, and a fuel injector body extending along an axis and fluidly connecting the fuel inlet to the fuel outlet such that fuel flows within the injector body. A cylindrical heating element radially surrounds the fuel injector body and operates to heat fuel flowing through the fuel injector body over a range spanning a colder temperature to a hotter temperature. An annular space is defined between the heating element and the fuel injector body sufficiently large to accommodate thermally caused radial differential expansion between the fuel injector body and the heating element. A conductive but compliant material fills the annular space and has a melting point sufficiently low to be a liquid as the heating element operates to thereby substantially prevent transfer of mechanical stress to the heating element due to the radial differential expansion.

BRIEF DESCRIPTION OF DRAWINGS

This invention will be further described with reference to the accompanying drawings in which.

Corresponding reference characters indicate corresponding parts throughout the several views. The examples set out herein illustrate various possible embodiments of the invention, including one preferred embodiment, but should not to be construed to limit the scope of the invention in any manner.

DETAILED DESCRIPTION OF INVENTION

Figure 1:
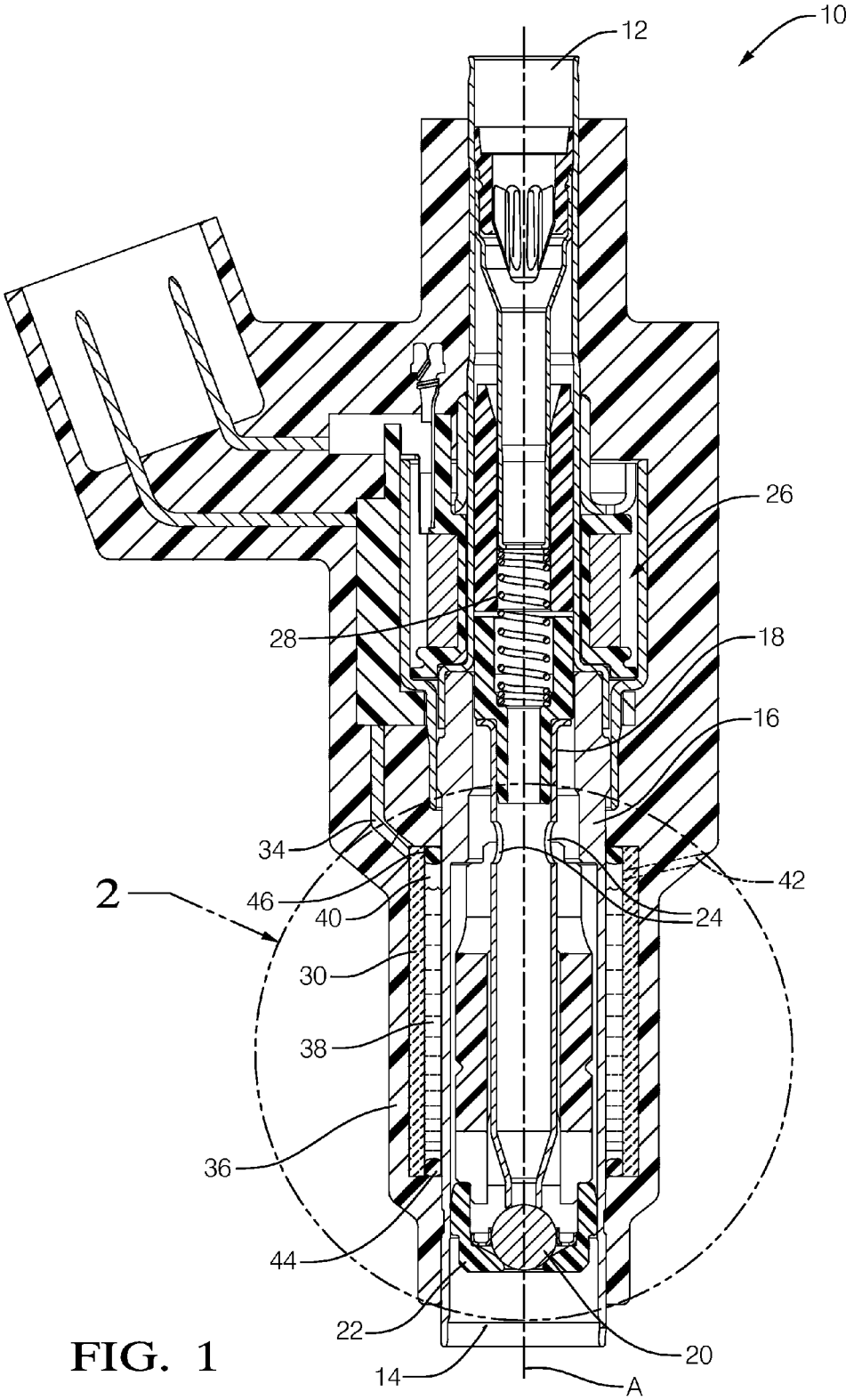
FIG. 1 is a cross-sectional view of a fuel injector in accordance with the present invention.

Referring to FIG. 1 a cross-sectional view of a fuel injector 10 is shown in accordance with the present invention for controlling delivery of fuel from a fuel source (not shown) to a fuel consuming device (not shown), for example, a combustion chamber of an internal combustion engine. Fuel injector 10 is provided with a fuel inlet 12 for introducing fuel from the fuel source into fuel injector 10. Fuel injector 10 is also provided with a fuel outlet 14 for dispensing fuel from fuel injector 10 to the fuel consuming device. A fuel injector body 16 of fuel injector 10 defines at least in part a flow path from fuel inlet 12 to fuel outlet 14 and extends along a fuel injector axis A. Fuel injector body 16 is preferably a metallic material, for example, stainless steel. A valve assembly which is coaxial to fuel injector body 16 includes a pintle shaft 18 and a valve 20. Valve 20 is attached to an end of pintle shaft 18 facing toward fuel outlet 14 for selectively sealing against a valve seat 22. At least a portion of pintle shaft 18 may be hollow as shown. Therefore, fuel may enter fuel injector body 16 from fuel inlet 12 through cross-holes 24 in pintle shaft 18. The valve assembly is positioned within fuel injector body 16 such that a reciprocating axial movement of pintle shaft 18 is enabled by actuation of a solenoid 26. Pintle shaft 18 is moved axially toward solenoid 26 when an electric current is applied to solenoid 26, thereby lifting valve 20 from valve seat 22 and allowing fuel to flow from fuel inlet 12 to fuel outlet 14. Conversely, a return spring 28 urges pintle shaft 18 axially away from solenoid 26 until valve 20 seals against valve seat 22 when no electric current is applied to solenoid 26, thereby stopping the flow of fuel from fuel inlet 12 to fuel outlet 14.

Figure 2:
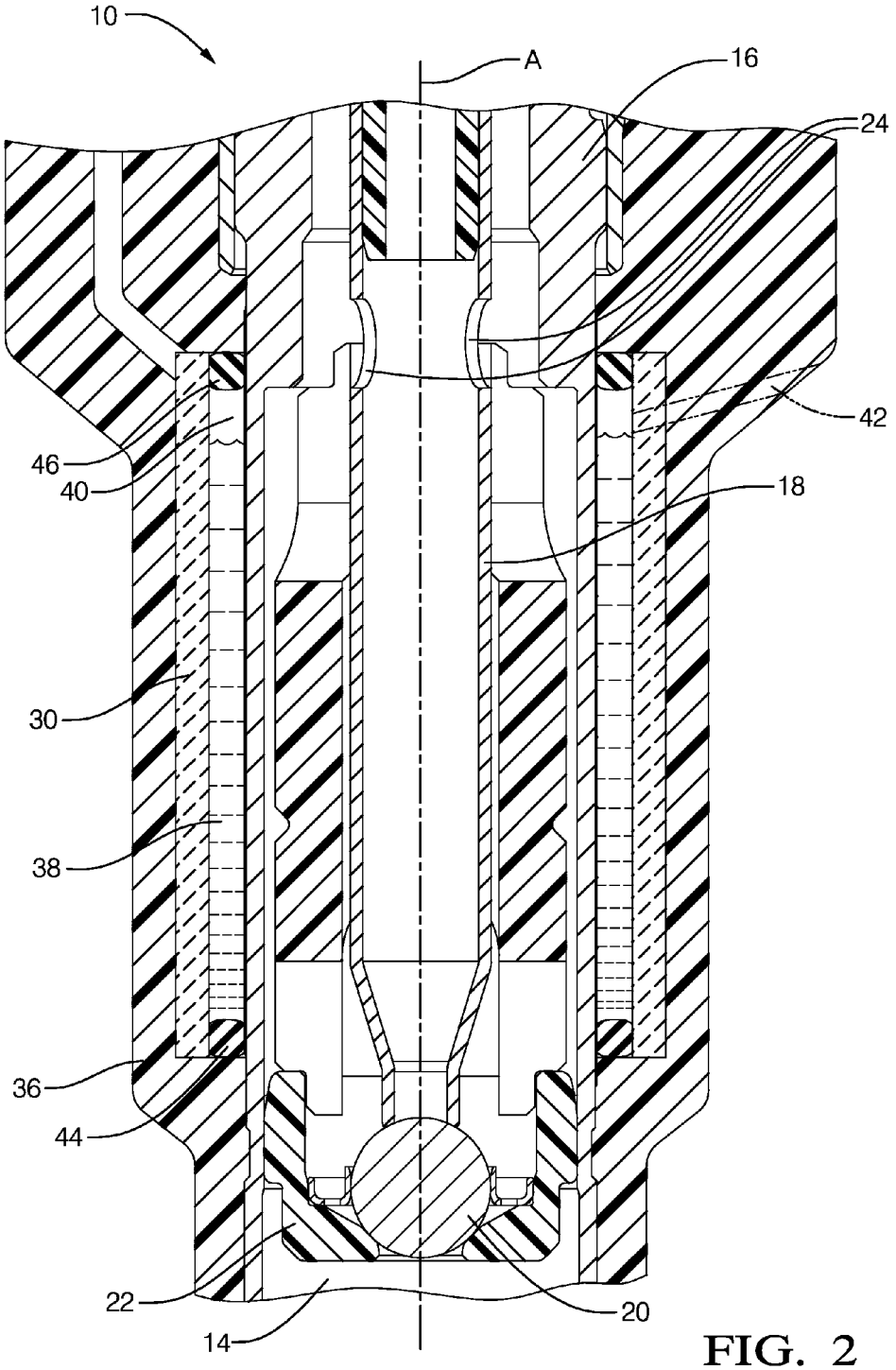
FIG. 2 is an enlarged portion of the fuel injector of FIG. 1.
Figure 3:
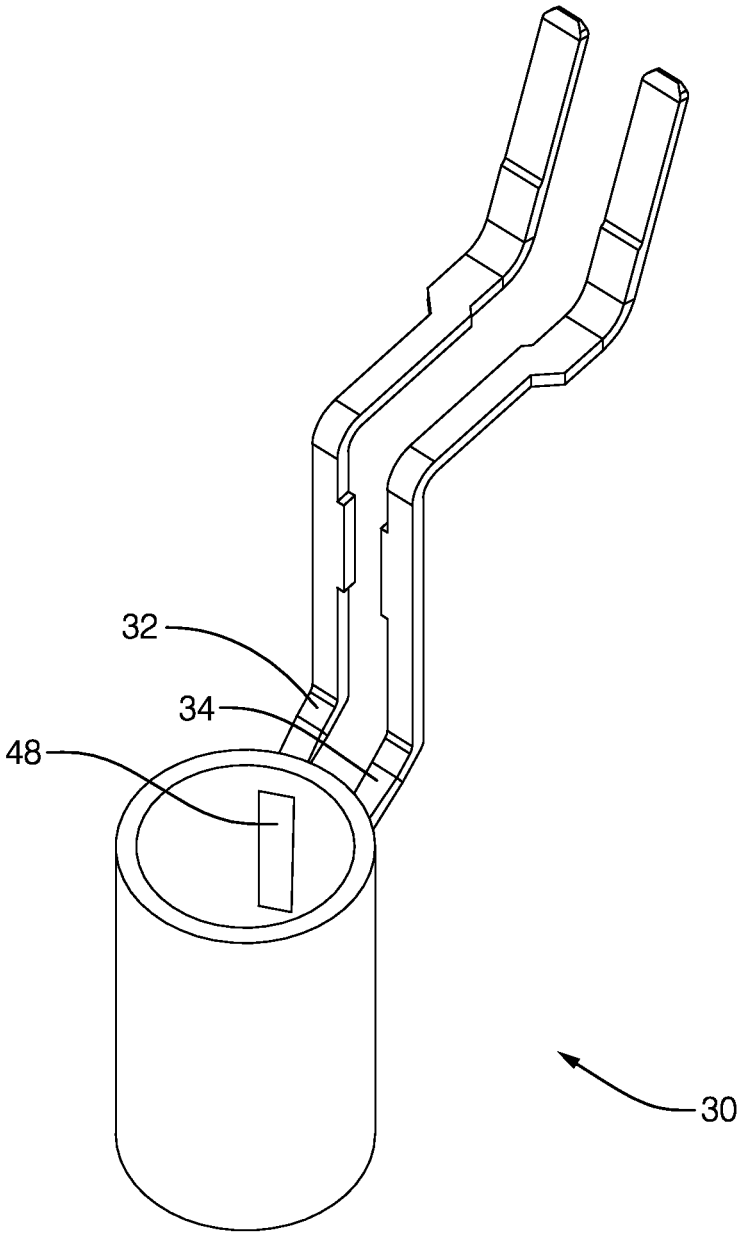
FIG. 3 is an isometric view of a resistive heating element of the fuel injector of FIGS. 1 and 2.

With continued reference to FIG. 1 and with additional reference to FIGS. 2 and 3, a resistive heating element 30 is provided in order to heat fuel within fuel injector body 16. Resistive heating element 30 is a hollow cylinder sized to provide an annular space radially between fuel injector body 16 and resistive heating element 30. The annular space may have a radial dimension, for example only, of about 0.2 mm to about 1.0 mm., but in any event should be sufficient to accommodate differential thermal expansion between the fuel injector body 16 and the resistive heating element 30, and thereby prevent a preferentially expanding fuel injector body 16 from pressing out against and stressing the heating element 30. Resistive heating element 30 includes a first electrical terminal 32 in electrical communication with an inside surface of resistive heating element 30 and a second electrical terminal 34 in electrical communication with an outside surface of resistive heating element 30. Resistive heating element 30 may be made of a ceramic PTC material which is self-regulating to a predetermined temperature, for example about 120° C., such that when first electrical terminal 32 and second electrical terminal 34 are connected to an electric power source (not shown) and an electric current is supplied thereto, resistive heating element 30 is heated to the predetermined temperature. A plastic overmold 36 is formed over fuel injector body 16, solenoid 26, resistive heating element 30, and other components of fuel injector 10 to form the exterior shell of fuel injector 10. Overmold 36 may be formed by injecting a liquid plastic material into a mold (not shown) containing fuel injector body 16, solenoid 26, resistive heating element 30, and other components of fuel injector 10. The liquid plastic material is allowed to cool and solidify before being removed from the mold.

In order to effectively transfer heat from resistive heating element 30 to the fuel within fuel injector body 16, the annular space between fuel injector body 16 and resistive heating element 30 is occupied by a substantially compliant and high thermal conductivity material, which may be a metallic material specifically illustrated as a solder 38. A suitable solder 38 fills and spans the annular space from the inside circumference of resistive heating element 30 to the outside circumference of fuel injector body 16, but may not totally fill the entire axial extent of the annular space under all operational circumstances. In this way, heat produced by resistive heating element 30 is efficiently transferred to fuel within fuel injector body 16 by conduction through solder 38 and fuel injector body 16.

Since fuel injector body 16 is made of a metallic material, fuel injector body 16 may expand at a greater rate than resistive heating element 30 which is made of a ceramic material when resistive heating element 30 is activated because metallic materials typically have a higher coefficient of thermal expansion than ceramic materials. Consequently, fuel injector body 16 may expand radially outward toward resistive heating element 30 when fuel injector body 16 and resistive heating element 30 are raised in temperature. In order to allow fuel injector body 16 to expand radially outward toward resistive heating element 30 without applying a radial outward force to resistive heating element 30, solder 38 is selected to have a melting point sufficiently low to melt sufficiently soon in the heating process to liquefy before substantial differential expansion occurs. The melting point of solder 38 is below the Curie point of resistive heating element 30 and preferably below 100° C., more preferably below 50° C., even more preferably below 25° C., and still even more preferably below 10° C. Solder 38 may be, for example only, Indalloy® 46L available from Indium Corporation® which is composed of by mass percentage 61.0% Ga, 25.0% In, 13.0% Sn and 1.0% Zn and has a melting point of about 7° C. The low melting point of solder 38 allows solder 38 to change to a liquid at a low temperature, thereby allowing fuel injector body 16 to expand radially outward toward resistive heating element 30 as the temperature of fuel injector body 16 increases freely, pushing the liquefied solder 38 axially upwardly, but not pushing the heating element 30 radially outwardly. In this way, solder 38 continually remains in direct thermal contact with both fuel injector body 16 and resistive heating element 30 over the operating range of fuel injector 10 without placing substantial stress on resistive heating element 30.

The cold temperature volume of solder 38 is chosen so as to leave some axial space between its top edge and the top edge of heating element 30. When solder 38 is in liquid form and fuel injector body 16 expands radially outward toward resistive heating element 30, both the squeezing action and the heat expansion of the solder 38 may cause the column of solder 38 in liquid form to rise. Accordingly, an annular expansion volume 40 is provided above the axially upper boundary of solder 38, to accommodate that expansion and rise. Expansion volume 40 may be vented to the atmosphere through a vent passage 42 (illustrated as phantom lines) in overmold 36 in order to prevent expansion volume 40 from being over pressurized. It should be noted, however, that this process may reverse itself somewhat as the ceramic heating element 30 reaches its Currie temperature, where it may begin to expand radially away from the injector body 16. In that case, the column of solder 38 can sink back down, remaining compliant and conductive, and depressurizing the space 40. In each particular case, empirical testing can find the right initial fill of solder 38 that will accommodate the entire heating process.

Solder 38 may be applied to the annular space between fuel injector body 16 and resistive heating element 30 during manufacture of fuel injector 10 by various methods. In one method, solder 38 may be applied as a solder paste to either the outer perimeter of fuel injector body 16 or the inner perimeter of resistive heating element 30 prior to resistive heating element 30 being positioned to surround fuel injector body 16. In another method, solder 38 may be flowed as a liquid into the annular space between fuel injector body 16 and resistive heating element 30.

In order to retain solder 38 within the annular space between fuel injector body 16 and resistive heating element 30 during manufacture and to prevent overmold 36 from intruding into the annular space between fuel injector body 16 and resistive heating element 30 when overmold 36 is formed, a lower seal 44 may be positioned at the end of resistive heating element 30 that is proximal to valve seat 22. Lower seal 44 blocks the lower end of the annular space between fuel injector body 16 and resistive heating element 30. Lower seal 44 is preferably a resilient and compliant material that is able to flex with the expansion and contraction of fuel injector body 16 and resistive heating element 30. Lower seal 44 may be, for example only, an adhesive. Similarly, an upper seal 46 may be positioned at the end of resistive heating element 30 that is opposite of lower seal 44. Upper seal 46 blocks the upper end of the annular space between fuel injector body 16 and resistive heating element 30. Upper seal 46 is preferably a resilient and compliant material that is able to flex with the expansion and contraction of fuel injector body 16 and resistive heating element 30. Upper seal 46 may be, for example only, an adhesive. Lower seal 44 and upper seal 46 may also be used to maintain resistive heating element 30 in a coaxial relationship with fuel injector body 16 during manufacturing of fuel injector 10.

In order prevent electrical shorting of first electrical terminal 32 which is in electrical communication with the inside surface of resistive heating element 30, the portion of first electrical terminal 32 which may come into contact with solder 38 may be covered with a coating 48 to electrically isolate first terminal from solder 38. Coating 48 may be, for example only, a non-electrically conductive epoxy material.

While the high thermal conductivity material within the annular space between fuel injector body 16 and resistive heating element 30 has been illustrated as solder 38, it should be understood that other metallic and non-metallic materials such as oils or waxes that have a sufficiently low melting point to liquefy within the annular space between fuel injector body 16 and resistive heating element 30 as resistive heating element 30 operates may be used, thereby substantially preventing transfer of mechanical stress to resistive heating element 30 due radial differential expansion between fuel injector body 16 and resistive heating element 30.

While this invention has been described in terms of preferred embodiments thereof, it is not intended to be so limited, but rather only to the extent set forth in the claims that follow.

We claim:

1. A heated fuel injector for supplying fuel to a fuel consuming device, said fuel injector comprising: a fuel inlet for receiving fuel; a fuel outlet for dispensing fuel from said fuel injector; a fuel injector body extending along an axis and fluidly connecting said fuel inlet to said fuel outlet, such that fuel flows within said fuel injector body; a cylindrical heating element radially surrounding said fuel injector body which operates to heat fuel flowing through said fuel injector body over a range spanning a colder temperature to a hotter temperature, with an annular space defined between said heating element and said fuel injector body sufficiently large to accommodate thermally caused radial differential expansion between said fuel injector body and heating element, and; a conductive material substantially filling said annular space and having a sufficiently low melting point to be a liquid as said heating element operates to thereby substantially prevent transfer of mechanical stress to said heating element due to said radial differential expansion.

2. A fuel injector as in claim 1 wherein said conductive material is a metallic material.

3. A fuel injector as in claim 2 where said metallic material is solder.

4. A fuel injector as in claim 1 wherein said melting point is below 50° C.

5. A fuel injector as in claim 4 wherein said melting point is below 10° C.

6. A fuel injector as in claim 1 further comprising a first seal to block one end of said annular space.

7. A fuel injector as in claim 6 further comprising a second seal to block the other end of said annular space.

8. A fuel injector as in claim 1 wherein said annular space includes an expansion volume to allow said metallic material to move axially as a result of said fuel injector body growing radially outward due to thermal expansion of said fuel injector body.

9. A fuel injector as in claim 8 wherein said expansion volume is vented to atmosphere.

10. A fuel injector as in claim 1 wherein said heating element includes a first electrical terminal in electrical contact with an inside surface of said heating element.

11. A fuel injector as in claim 10 wherein said first electrical terminal is covered with a non-electrically conductive coating to electrically isolate said first electrical terminal from said conductive material.

12. A fuel injector as in claim 10 wherein said heating element includes a second electrical terminal in electrical contact with an outside surface of said heating element.

13. A fuel injector as in claim 1 wherein said heating element is a PTC ceramic material.

14. A fuel injector as in claim 1 where said conductive material is an oil.

15. A fuel injector as in claim 1 where said conductive material is a wax.

* * * * *